US005593242A

United States Patent [19]

Mathias

[11] Patent Number: 5,593,242

[45] Date of Patent: Jan. 14, 1997

[54] FILING OF SHEETS OF PAPER

[75] Inventor: Claudia B. Mathias, Frauenfeld, Switzerland

[73] Assignee: Kemtek SA, Zollikon, Switzerland

[21] Appl. No.: 306,107

[22] Filed: Sep. 14, 1994

[30] Foreign Application Priority Data

Sep. 15, 1993 [ZA] South Africa ..... 93/6804

[51] Int. Cl.[6] ..... B42F 13/10; B42F 13/42

[52] U.S. Cl. ..... 402/7; 402/13; 402/18; 402/19; 402/47; 402/60; 402/68; 402/80 R; 402/80 P

[58] Field of Search ..... 402/60, 7, 8, 11, 402/13–18, 19, 20, 47, 21, 68, 80 R, 80 P; 24/67 CF

[56] References Cited

U.S. PATENT DOCUMENTS

| | | | |
|---|---|---|---|
| 4,084,911 | 4/1978 | Dewitt | 402/15 |
| 4,269,530 | 5/1981 | Weber | 402/15 |
| 4,300,848 | 11/1981 | Waegemann | 402/13 |
| 4,427,315 | 1/1984 | Raisch | 402/7 X |
| 4,632,586 | 12/1986 | Erickson | 402/80 R X |
| 4,869,613 | 9/1989 | Corey | 402/80 R X |
| 4,979,841 | 12/1990 | Lauder | 402/80 R X |
| 5,028,160 | 7/1991 | Callander | 402/80 R X |
| 5,169,255 | 12/1992 | Jensen | 402/80 R |
| 5,417,506 | 5/1995 | Eeningenburg et al. | 402/15 X |

FOREIGN PATENT DOCUMENTS

| | | | |
|---|---|---|---|
| 486698 | 11/1929 | Germany | 402/80 R |
| 541392 | 12/1931 | Germany | 402/80 R |
| 3103318 | 8/1982 | Germany | 402/1 |
| 210259 | 1/1924 | United Kingdom | 402/20 |
| 2035215 | 6/1980 | United Kingdom | 402/80 R |

*Primary Examiner*—Frances Han

*Attorney, Agent, or Firm*—Senniger, Powers, Leavitt & Roedel

[57] ABSTRACT

A filing strip is of a bendable material. The filing strip has a central elongate anchor strip and a prong extending from each end of the strip. Each prong has a tip portion and an intermediate portion. Each tip portion is narrower than its adjacent intermediate portion. The invention extends to a filing accessory for use with the filing strip, The accessory includes a pair of elongate members. A socket defining element is arranged on an end of each member. Each socket has internal dimensions complementary to the tip portion of the prong and external dimensions which are substantially equal to external dimensions of the intermediate portion of the prong. The invention also extends to a filing accessory for use with a filing strip having a pair of opposed prongs. With this accessory a free end of each socket defining element is chamfered.

11 Claims, 2 Drawing Sheets

FILING OF SHEETS OF PAPER

FIELD OF THE INVENTION

THIS INVENTION relates to the filing of sheets of paper in a cover.

BACKGROUND OF THE INVENTION

It is known to file sheets of paper in a cover by means of a plastically deformable strip. The strip has a central elongate anchor strip and a prong at each end. The anchor strip is substantially flat and the prongs are bent over, in the same direction, to adopt a "U"-shape. The anchor strip is secured to the cover. If any sheets of papers are to be filed, spaced holes are punched along an edge thereof, the prongs are threaded through the holes and the exposed portions of the prongs are then bent towards each other to retain the sheets of paper in the cover in a stack. If further sheets are to be added or sheets are to be removed, the prongs are straightened and further sheets added or sheets removed and the prongs are then bent towards each other to retain the desired sheets in the cover.

As an enhancement, a known further "U"-shaped filing accessory is provided having two legs with a circular cylindrical socket at each end with the tips of the prongs being receivable in these sockets. Thereby, when the prongs are straightened, the tips are inserted into the sockets and sheets of paper may then be transferred from the filing strip onto the legs of the filing accessory. With these known filing accessories there is a step between the prong and sockets which is problematical in that it makes it difficult to transfer sheets of paper from the prongs to the accessory. In this manner, if a sheet of paper in the middle of the stack is to be accessed, the sheets of paper on top of it are transferred onto the accessory, the legs of the accessory are disengaged from the prongs and the desired sheet of paper is removed. Similarly, if a sheet of paper is to be inserted into the stack instead of on top of it, the appropriate sheets of paper are transferred onto the accessory, the legs of the accessory removed from the prongs and the prongs are threaded through the holes in the further sheet of paper. The legs of the accessory are then again engaged with the prongs and the sheets of paper thereon transferred back onto the prongs. The accessory is removed and the prongs are folded over to retain the stack of papers in the cover.

SUMMARY OF THE INVENTION

According to a first aspect of the invention there is provided a filing strip which is of a bendable material, the filing strip having a central elongate anchor strip and a prong extending from each end of the strip, each prong having a tip portion and an intermediate portion, with each tip portion being narrower than its adjacent intermediate portion.

The strip may be a clearly defined piece or a piece which is defined in use.

Each prong may be stepped to define the narrowed tip portion and at least one shoulder at the transition from each tip portion to its adjacent intermediate portion. The, or each, shoulder may taper outwardly from its tip portion to its intermediate portion.

The free end of each tip portion may be shaped to be rounded or pointed.

The prongs may be substantially flat, such that the prongs have a width that is substantially greater than their thickness.

The filing strip may be of a metal. Instead, the filing strip may be of a suitable synthetic plastics material.

The filing strip may be manufactured by a blanking process. Instead, the filing strip may be injection moulded. The narrowed tip portions of the prongs may be provided by rolling over edge regions thereof.

The filing strip may be of a plastically deformable material or of a flexible material.

A retaining member may be provided for retaining the prongs in a bent-over configuration to hold the sheets of paper in the cover.

According to a second aspect of the invention there is provided a filing accessory for use with the filing strip described above, the accessory including a pair of elongate members; and a socket-defining element, which defines a socket, arranged on an end of each member, each socket having internal dimensions complementary to the tip portion of the prong and external dimensions which are substantially equal to external dimensions of the intermediate portion of the prong.

The filing accessory may include a base member, the other end of each elongate member opposed to the socket-defining element being connected to the base member.

The filing accessory may be of a flexible material.

Each socket-defining element may have a substantially rectangular, external transverse profile. It is to be appreciated that, by "rectangular", is meant a profile which has two long sides and two short sides. It will be understood that such a profile mates better with a flat prong, than is the case with a socket-defining element having a cylindrical, external profile.

Instead, each socket-defining element may have an oval, external transverse profile.

A free end of each socket-defining element may be chamfered.

The filing accessory may be of a plastics material.

The invention extends to a filing strip as described earlier in combination with the filing accessory described above.

It will be appreciated that, in use, the narrowed tip portions of the prongs are inserted in the socket-defining elements and, because the external width of the socket-defining elements and the width of the intermediate portions are substantially equal, it is easier to transfer sheets of paper from the prongs onto the accessory than with existing filing strips and accessories.

According to a third aspect of the invention, there is provided a filing accessory for use with a filing strip having a pair of opposed prongs, the accessory including a pair of elongate members; and a socket-defining element, which defines a socket, on an end of each elongate member, each socket being dimensioned so that an end of a prong is receivable within the socket, a free end of each socket-defining element being chamfered.

The filing accessory may include a base member, an end of each elongate member opposed to the socket-defining element being connected to the base member.

Each socket-defining element may have a substantially rectangular, external transverse profile. Instead, each socket-defining element may have an oval, external transverse profile.

The filing accessory may be of a flexible material and, in particular, may be of a plastics material.

The invention extends to a filing strip having a central elongate anchor strip and a prong extending from each end of the strip in combination with the filing accessory described above.

BRIEF DESCRIPTION OF THE DRAWINGS

The invention is now described, by way of example, with reference to the accompanying drawings, in which.

DETAILED DESCRIPTION OF THE DRAWINGS

Figure 1:
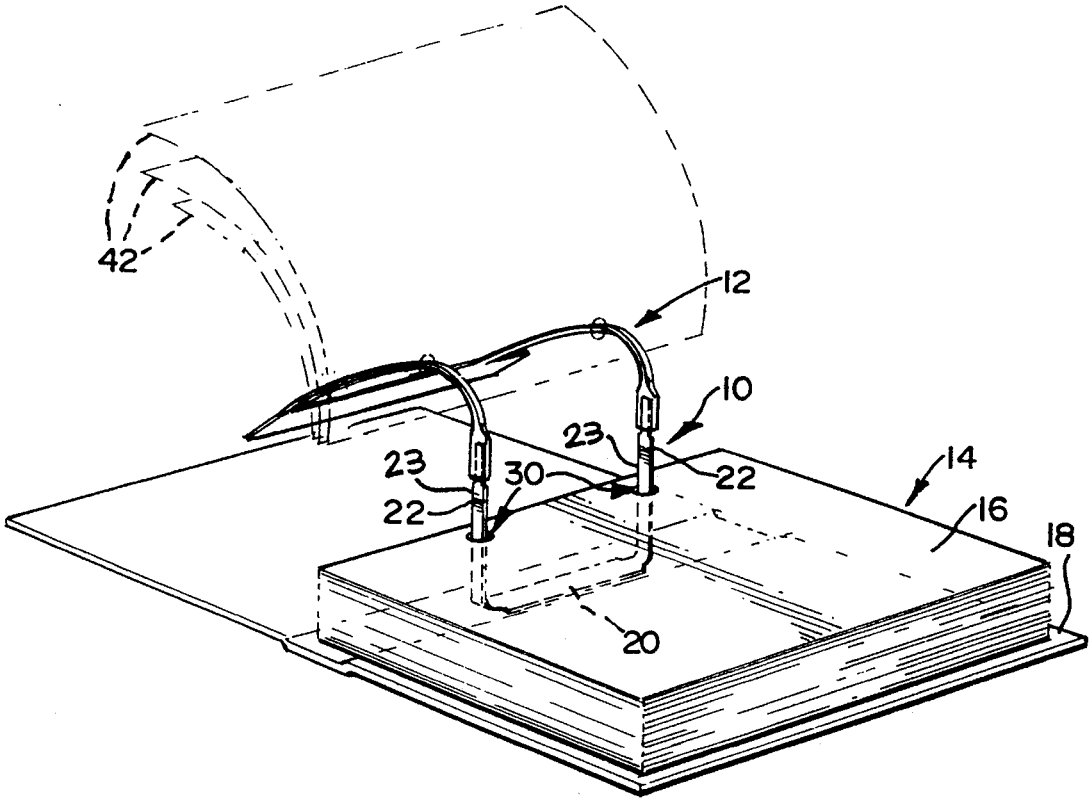
FIG. 1 shows an improved filing strip and a filing accessory, in accordance with the invention, and the manner in which they are used.

Referring to FIG. 1, a filing strip in accordance with the invention is designated generally by reference numeral 10 and a filing accessory in accordance with the invention is designated generally by reference numeral 12. As seen in FIG. 1, the filing strip is utilised to hold a stack 14 of sheets of paper 16 in a cover 18.

Figure 2:
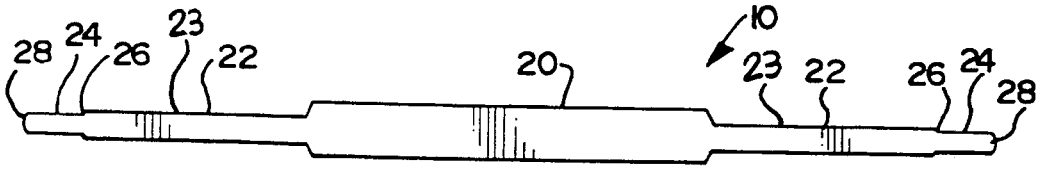
FIG. 2 shows a plan view of the filing strip.

Referring also to FIG. 2, it will be seen that the strip 10 has a central, elongate anchor strip 20 and a prong 22 extending from each end thereof. The anchor strip 20 is wider than the prongs 22. Each prong 22 has a tip portion 24 and an intermediate portion 23, with each tip portion 24 being narrower than its adjacent intermediate portion 23. There is a shoulder 26 at the transition from each tip portion 24 to its adjacent intermediate portion 23. Each shoulder 26 tapers outwardly from its tip portion 24 to its intermediate portion 23. The tip portion 24 has a rounded tip 28.

The strip 10 is of metal and is conveniently of plated mild steel. The strip 10 is supplied flat, as indicated in FIG. 2. The anchor strip 20 may be supplied secured to the cover 18 or separate therefrom. If the anchor strip 20 is not fastened to the cover 18, the cover 18 is provided with two spaced openings and, when the cover 18 and strip 10 are to be used, the prongs 22 are bent upwardly and towards each other and threaded through the openings in the cover 18, from the outside, in a known manner.

Further, in use, sheets of paper 16 with holes 30 punched therein are filed in the cover 18 by threading the prongs 22 through the holes 30 to form the stack 14 and the prongs 22 are then bent inwardly to hold the stack 14 in position. A locking component (not shown) is also used for this purpose.

Figure 3:
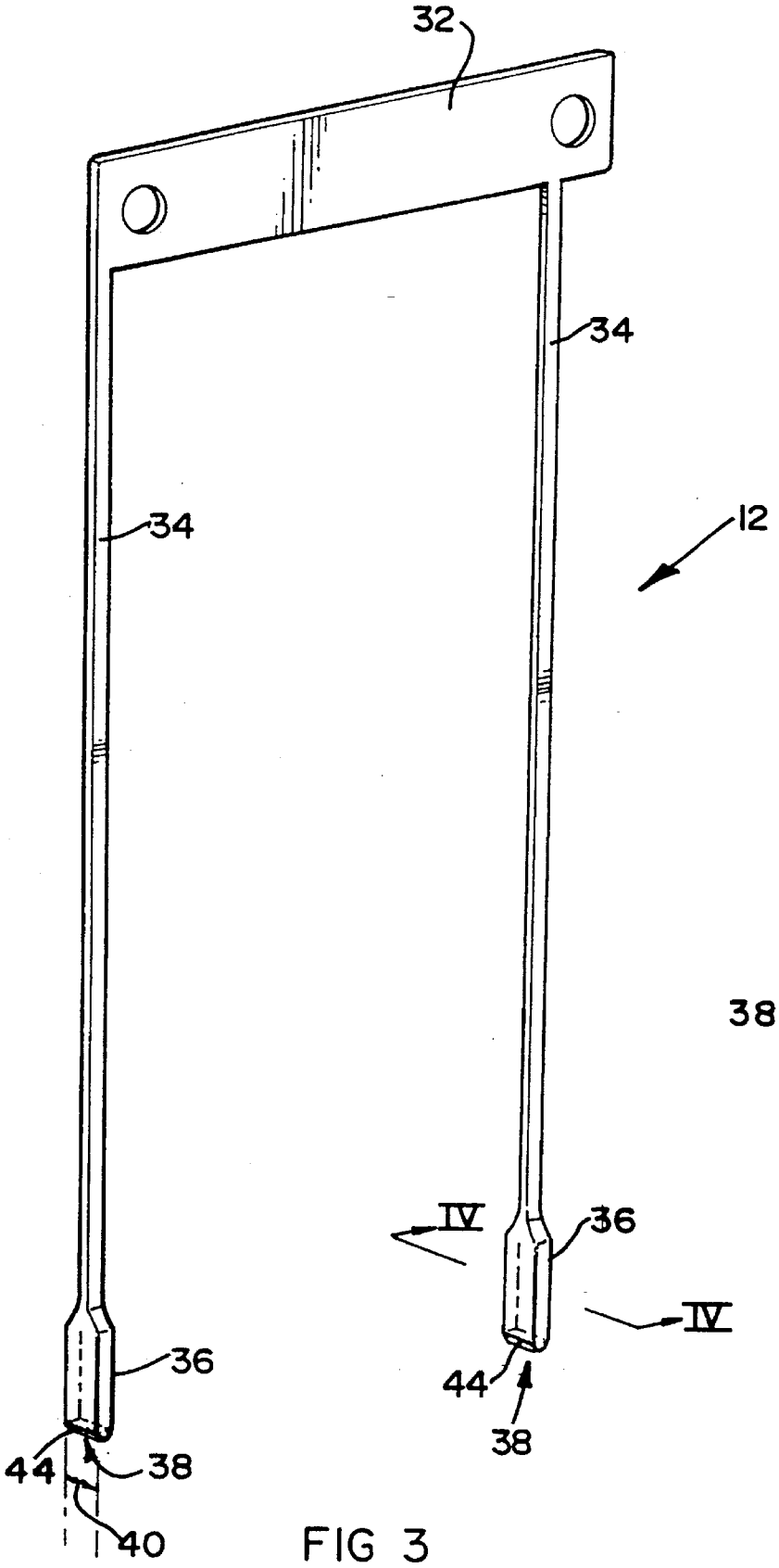
FIG. 3 shows a perspective view of the filing accessory.
Figure 4:
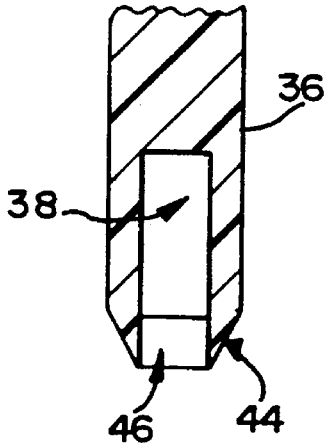
FIG. 4 shows a detailed cross-sectioned view of a socket-defining element of the filing accessory.

If a sheet of paper is to be removed from the stack 14 or a further sheet inserted somewhere in the stack 14, the filing accessory 12 is utilised. Thus, with reference also to FIG. 3, the accessory 12 is substantially "U"-shaped to have a base member 32 and a pair of elongate members in the form of legs 34 extending therefrom. The spacing between the legs 34 is the same as the length of the anchor strip 20. Each leg 34 has a socket-defining element 36 at its free end. Each socket-defining element 36 defines a socket 38 as is clearly seen in FIG. 4. The tip portions 24 are received in the sockets 38. It will be noted that the elements 36 have a width dimension 40 which is substantially the same as the width of the intermediate portions 23. The filing accessory 12 is of a flexible synthetic-plastics material.

In use, the prongs 22 are straightened so that they extend upwardly from the stack 14 and the tip portions 24 are inserted in the sockets 38. The appropriate sheets of paper 42 may then be lifted and passed from the intermediate portions 23 onto the legs 34. Because the external dimensions of the intermediate portions 23 and the elements 36 are substantially equal, it is easy to transfer the sheets of paper 42 from the stack 14 onto the filing accessory 12. To further facilitate this, the broader sides of the free ends of the elements 36 are externally chamfered, as indicated at 44 in FIG. 4. In addition, the narrower sides are internally tapered to complement the tapered shoulders 26, as shown at 46. Further, the elements 36 are substantially flat and rectangular so that passage of the sheets of paper 42 from the intermediate portions 23 onto the legs 34 is facilitated. When the sheets of paper 42 are located on the accessory 12, the elements 36 are disengaged from the tip portions 24 and the appropriate sheets of paper removed or added. The elements 36 are then re-engaged with the tip portions 24 and the sheets of paper 42 returned onto the intermediate portions 23 to re-form the stack 14. The accessory 12 is then removed and the prongs 22 bent inwardly again to hold the stack 14 in the cover 18.

It will be appreciated that the shoulders 26 may be square and the narrower sides of the elements 36 need not be internally tapered.

I claim:

1. A combination of a filing strip and a filing accessory in which the filing strip is of a bendable material and comprises a central elongate anchor strip and a substantially flat prong extending from each end of the strip, each prong having a width substantially greater than its thickness and having a tip portion and an intermediate portion, with each tip portion being substantially flat and being narrower than its adjacent intermediate portion and having a substantially constant width, and each prong being stepped to define the narrowed tip portion and a pair of shoulders at the transition from each tip portion to its adjacent intermediate portion, and in which the filing accessory has a pair of elongate members and a socket-defining element, which defines a socket, arranged on an end of each member, each socket having a substantially rectangular, internal transverse profile with internal dimensions complementary to the tip portion of the prong, and each element having a substantially rectangular external transverse profile at its free end which has a width substantially equal to that of the intermediate portion of the prong, the tip portion being entirely receivable in the socket with the socket defining element engaging the shoulders of the prong, the intermediate portion of the prong having longitudinal edges the longitudinal edges of the intermediate portion and the longitudinal edges of the socket-defining element being substantially collinear when the tip portion is entirely received within the socket such that a smooth transition is provided from the intermediate portion of the filing strip to the socket-defining element.

2. The combination as claimed in claim 1, in which the free end of each tip portion is generally rounded.

3. The combination as claimed in claim 1, in which the filing strip is of a metal.

4. The combination as claimed in claim 3, in which the filing strip is manufactured by a blanking process.

5. The combination as claimed in claim 1, in which the filing strip is of a suitable synthetic plastics materials.

6. The combination as claimed in claim 5, which is injection moulded.

7. The combination as claimed in claim 1, in which the filing strip is of a plastically deformable material.

8. The combination as claimed in claim 1, in which the filing strip is of a flexible material.

9. The combination as claimed in claim 1, in which the filing accessory includes a base member, the other end of each elongate member opposed to the socket-defining element being connected to the base member.

10. The combination as claimed in claim 1, in which the filing accessory is of a flexible material.

11. The combination as claimed in claim 1, in which the filing accessory is of a plastics material.

* * * * *